US005259674A

United States Patent [19]

Hedaya et al.

[11] Patent Number: 5,259,674

[45] Date of Patent: Nov. 9, 1993

[54] BAG EXPANDER AND BAG CONTAINING SAME

[75] Inventors: Maurice Hedaya; Ezra Hedaya, both of Brooklyn, N.Y.

[73] Assignee: Barclay Brown Inc., Brooklyn, N.Y.

[21] Appl. No.: 917,857

[22] Filed: Jul. 22, 1992

[51] Int. Cl.[5] ..... B65D 30/00

[52] U.S. Cl. ..... 383/127

[58] Field of Search ..... 141/114, 390; 383/127; 229/123.2

[56] References Cited

U.S. PATENT DOCUMENTS

| | | | |
|---|---|---|---|
| 518,574 | 4/1894 | Procter . | |
| 2,265,889 | 12/1941 | Belz | 229/123.2 |
| 2,269,796 | 1/1942 | Strasser . | |
| 2,517,801 | 8/1950 | Rough | 229/123.2 |
| 2,640,520 | 6/1953 | Miller et al. . | |
| 2,730,153 | 1/1956 | Miller et al. . | |
| 2,795,259 | 6/1957 | Nash . | |
| 2,819,749 | 1/1958 | Renz et al. . | |
| 2,895,865 | 7/1959 | Humphner | 229/123.2 |
| 4,077,451 | 3/1978 | Zoland . | |
| 4,141,399 | 2/1979 | Zoland . | |
| 4,142,564 | 3/1979 | Zoland . | |
| 4,434,894 | 3/1984 | Lee . | |
| 4,760,982 | 8/1988 | Cooke | 141/390 |
| 4,946,292 | 8/1990 | Diamond et al. . | |
| 4,969,751 | 11/1990 | Diamond et al. . | |
| 4,993,846 | 2/1991 | Diamond et al. . | |
| 5,030,014 | 7/1991 | Diamond et al. . | |
| 5,033,780 | 7/1991 | Wootten . | |

*Primary Examiner*—Stephen P. Garbe

*Attorney, Agent, or Firm*—Amster, Rothstein & Ebenstein

[57] ABSTRACT

An expander, suitable for use in an expandable bag having a closure, includes a stuffer movable from a collapsed orientation wherein the stuffer is substantially flat to an expanded orientation wherein said stuffer is not substantially flat. The stuffer is biased for movement from the collapsed orientation to the expanded orientation. A tearable band disposed about the stuffer releasably maintains the stuffer in the collapsed orientation, and a tearing mechanism is provided for tearing the tearable band to enable the stuffer to move from the collapsed orientation to the expanded orientation, the tearing means being operable from outside the bag.

The stuffer is disposed in the bag in the collapsed orientation with the closure closed, the tearable band being disposed in the bag and the tearing mechanism being disposed partially within the bag and partially without the bag.

14 Claims, 1 Drawing Sheet

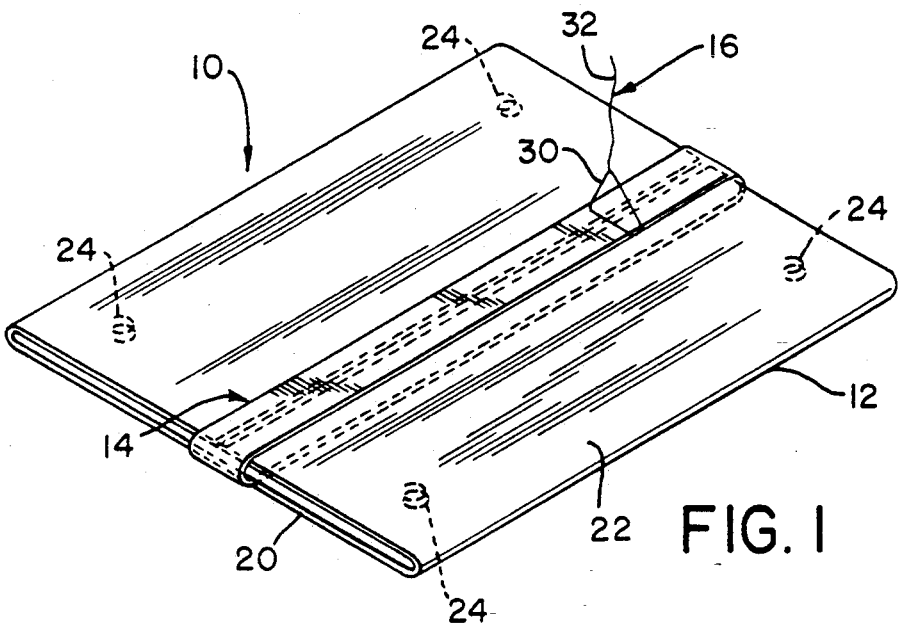
FIG. 1
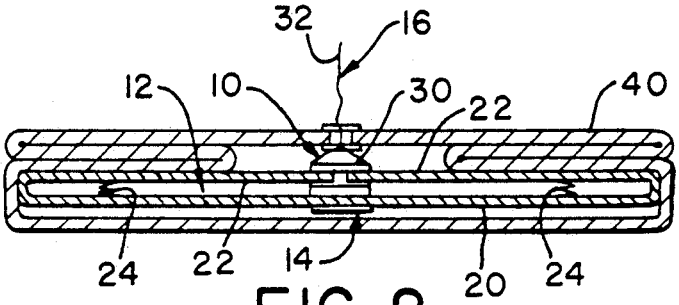
FIG. 2
FIG. 3
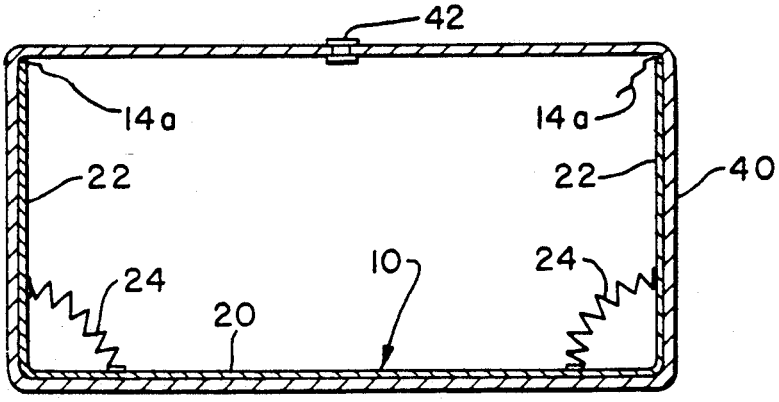

BAG EXPANDER AND BAG CONTAINING SAME

BACKGROUND OF THE INVENTION

The present invention relates to expanders for expandable bags and to combinations of such expanders and such bags.

Particularly in the bag market, such as flexible sided cosmetic bags, purses and luggage, there is a conflict between the needs of transporters or shippers to pack the bags flat for minimum freight charges (typically based on both weight and volume) and the needs of retailers for the bags to be expanded, rather than flattened, when they are on display at point-of-sale presentations. The conflict is resolved by use of an expander, including an expandable stuffer which can be inserted inside a hollow article, such as a bag, while in a flat condition, and, at any stage in the future, can be activated to expand the bag. The device comprises a stuffer including biasing means, and a releasable member which normally holds the stuffer or biasing means compressed but can be released to permit the stuffer or biasing means to expand.

A variety of expandable stuffers of different configurations and dimensions are well known in the stuffer art. A very simple stuffer comprises simply a pair of parallel sheet members and means biasing the parallel sheet members apart (as in U.S. Pat. No. 4,077,451). In slightly more complex stuffers, there is a base sheet and a pair of hinged flaps pivotally secured to opposite sides thereof so that the stuffer can move from a collapsed orientation wherein the flaps are parallel to the base sheet to an expanded configuration wherein the flaps are more-or-less transverse thereto. These stuffers may assume an expanded configuration similar to a "U" where both flaps open on the same side of the base sheet or a "N" or "Z" where the two flaps open on opposite sides of the base sheet. In even more complex stuffers, the biasing means does not act directly on the flaps, but rather on intermediate members which, as they move to their final orientation under the influence of the biasing means, move the flaps to their expanded orientation.

It is known to provide an expandable stuffer which is maintained in the collapsed orientation within an expandable bag for shipment and storage by means of a band of string, wrap or the like disposed externally of and snugly about the bag (or plurality of bags) so that, once the band or wrap is cut, the bag is free to move to its expanded orientation under the influence of the biasing means. This type of expander has not met with commercial success because the band or wrap can mar or tear the exterior surface of the bag.

The aforementioned U.S. Pat. No. 4,077,451 discloses an expander wherein the stuffer comprises a pair of parallel sheet members and spring means biasing them apart. The stuffer is maintained in a collapsed orientation by means of a tie member. The tie member includes an enlarged head on one end, an enlarged eye on the other end, and a body connecting the eye and the head and passing through both sheet members. When the bag is in the collapsed orientation, the head abuts the external face of the first sheet member and the eye is disposed adjacent the external face of the other sheet member, the first sheet member defining a small aperture precluding passage of the enlarged head therethrough and the second sheet member defining an aperture large enough to permit passage of the eye therethrough. In order to maintain the stuffer in the collapsed orientation, a latching pin is disposed through the eye parallel to the sheet members and abuts against the external surface of the second sheet member, thereby precluding its movement under the influence of the biasing means. A string has one end secured to the latching pin and the other end disposed outside the bag so that, when the free end of the string is pulled, the latching pin is pulled out of the eye and the aperture of the second sheet member is then free to pass over the eye, under the influence of the biasing means pushing apart the sheet members, so that the stuffer assumes the expanded orientation and thereby also expands the bag.

While the latch system of U.S. Pat. No. 4,077,451 eliminates the possibility of the expander marring or tearing the external surface of the bag, it poses a similar threat to the internal surface of the bag and hence has not proven entirely satisfactory. More particularly, the latching pin which passes through the eye of the tie member must be rigid and the tie member itself (or at least portions thereof) must also be rigid—for example, to preclude the enlarged head from passing through aperture of the first sheet member and to prevent the eye from collapsing tightly on the latching pin therethrough and precluding release of the latching pin therefrom. Thus there are necessarily rigid elements on the external surfaces of the stuffer (the latching pin, the eye, and the enlarged head) which are capable of marring or tearing the interior surface of the bag while the stuffer is in the collapsed orientation, as the stuffer is moving from the collapsed orientations to the expanded orientation, and while the stuffer is in the expanded orientation. Of particular importance in this matter is the use of a rigid latching pin which during the latch release procedure is being forcibly moved relative to the eye of the tie member and presumably against the interior surface of the bag where the string passes through the bag. Such motion is highly likely to cause the marring or tearing of the interior surface of the bag.

Furthermore, assuming that the flexible string can easily pass through the opening in the bag, the larger and more rigid latching pin typically will not be able to do so. Thus, after the unlatching procedure is completed and the stuffer assumes the expanded orientation, there remains a long string hanging out of the bag which must now be cut and removed for aesthetic reasons.

Additionally, once the bag has been opened after purchase, there are accessible therein small members—namely, the tie member and the latching pin—which presented a danger to children since each may be of an appropriate size to be swallowed by a child.

Finally, as is any latching system, there exists the possibility of the latching pin becoming frozen in the eye through which it passes, so that the stuffer cannot be released and never assumes its expanded orientation.

Accordingly, it is an object of the present invention to provide an expander which does not present a threat of marring or tearing to either the interior or exterior surfaces of the bag.

Another object is to provide such an expander which is operable in a closed bag by means of a string disposed Partially outside of the bag, and, in a preferred embodiment, permits the string to be totally removed from the bag as part of the process of moving the stuffer from a collapsed orientation to an expanded orientation.

A further object is to provide such an expander which does not leave in the bag small members which pose a danger to children opening the bag.

It is also an object of the present invention to provide in combination such an expander and an expandable bag.

SUMMARY OF THE INVENTION

It has now been found that the above and related objects of the present invention are obtained in an expander according to the present invention. The expander is for use in an expandable bag having a closure and comprises a stuffer movable from a collapsed orientation, wherein the stuffer is substantially flat, to an expanded orientation wherein the stuffer is not substantially flat. Preferably, although not necessarily, the stuffer 12 is also manually movable from the expanded orientation to the collapsed orientation. The stuffer is biased for movement from the collapsed orientation to the expanded orientation. A tearable means is disposed about the stuffer for releasably maintaining the stuffer in the collapsed orientation, and a tearing means is provided for tearing the tearable means to enable the stuffer to move from the collapsed orientation to the expanded orientation. The tearing means is operable from outside the bag.

In a preferred embodiment, the tearable means is disposed about the stuffer in the compact orientation and intended to be disposed therewith within the bag, and the tearing means is secured to at least one of the stuffer and the tearable means and intended to be disposed therewith partially within the bag and partially without the bag. Preferably the tearable means is paper, and the tearing means is string. The tearable means and the tearing means are both desirably soft and flexible. The tearable means is typically disposed exclusively externally of the stuffer.

The present invention also encompasses, in combination, the expander and an expandable bag having a closure, the closure being closed. The stuffer is disposed in the bag in the collapsed orientation, the tearable means is disposed in the bag, and the tearing means is disposed partially within the bag and partially without the bag.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 1 is an isometric view of an expander according to the present invention;

FIG. 2 is a sectional view of the expander in an expandable bag, the expander being in the collapsed orientation; and FIG. 3 is a sectional view of the expander in the bag after the string has been pulled and the expander has assumed the expanded orientation.

DETAILED DESCRIPTION OF THE PREFERRED EMBODIMENTS

Referring now to the drawing, and in particular to FIG. 1 thereof, therein illustrated is an expander according to the present invention generally designated by the reference numeral 10. In its essential elements, the expander 10 includes an expandable stuffer generally designated 12, a tearable band generally designated 14, and a tearing means generally designated 16.

The stuffer 12 may be of any configuration and dimensions suitable for use in the intended expandable bag, and may consist of any of the types previously described herein or otherwise described in the prior art—for example, a pair of parallel sheet members and means for biasing them apart, a base sheet and two pivotable flaps adapted to assume a U-, N- or Z-shaped expanded orientation, a stuffer having intermediate flaps which are acted on by the biasing means and used to open the main flaps relative to the base sheet, or the like. As illustrated, the stuffer is formed of a base sheet 20 and a pair of sheet-like flaps 22, each flap 22 being connected to a respective long side of the base sheet 20 for pivotal movement relative thereto. The stuffer 12 is movable from a collapsed orientation wherein the stuffer 12 is substantially flat, with the flaps 22 being generally parallel to the base sheet 20, to an expanded orientation where the stuffer 12 is not substantially flat and the flaps 22 are more-or-less transverse to the base sheet 20.

The stuffer 12 additionally includes means 24 for biasing the stuffer for movement from the collapsed orientation (illustrated in FIGS. 1 and 2) to the expanded orientation (illustrated in FIG. 3). For expository purposes, the biasing means 24 is illustrated as four coil compression springs 24, each spring 24 being configured as a cylindrical helix and each spring pair being associated with the base sheet 20 and one of the flaps 22. Depending upon the level of the biasing force desired (which in turn may be related to the size of the stuffer, the stiffness of the bag, and the like), a lesser or greater number of biasing means 24 may be employed for moving each flap 22 from the collapsed orientation to the expanded orientation. Any of a variety of different biasing means well known in the art may be used, including helical springs of metal or plastic, leaf spring and the like. As the biasing means is typically sandwiched between the flaps 22 and the base sheet 20 when the stuffer 12 is in the collapsed orientation, and is buried in the hollow of the bag when the stuffer 12 is in the expanded orientation, the biasing means 24 are not in a position where they are likely to mar or tear the inner surface of the bag containing the stuffer 12, whether the stuffer 12 is in a collapsed or expanded orientation. At least in those products that are likely to be opened by children, care should be taken to ensure that each of the biasing means 24 is either permanently secured to the stuffer 12 (that is, the base sheet 20, a flap 22, or both) or of such a large size that it cannot accidentally be swallowed by a child.

The base sheet 20 and flaps 22 are preferably of integral, one-piece, unitary construction, formed from a single material with living hinges connecting the flaps 22 to the base sheet 20. The base sheet 20 and flaps 22 may be formed from cardboard, plastic (e.g., polystyrene, low-density polyethylene, etc.) or like material capable of forming a living hinge intermediate each flap 22 and the base sheet 20. The material is preferably selected for sufficient rigidity to effect the desired expansion of the expandable bag under the influence of the biasing means 24, yet soft enough that it cannot mar or tear the inner surface of the expandable bag. As the illustrated stuffer 12 is only one of a variety of different types of stuffers known in the art which are useful in the present invention, further details regarding the same are not deemed necessary herein.

A tearable means 14, such as a band or strip of non-woven fibrous textile cloth (e.g., paper), is disposed about the stuffer 12 for releasably maintaining the stuffer 12 in the collapsed orientation. The band 14 is illustrated as being disposed so as to cover both free ends of the flaps 22 on one surface of the stuffer 12 and to cover the base sheet 20 on the other surface of the stuffer 11. Typically, such a longitudinally extending band 14 is nonadhesively wrapped about the stuffer 12 and is either a continuous band or a non-continuous band simply secured to itself (for example, by a pressure-sensitive glue or adhesive). Alternatively, the band may be secured (as by glues or adhesives) to the base sheet 20, but typically not secured to the flaps 22 except by virtue of their abutment. (In another words, there is typically no direct securing of the band 14 to the flaps 22.) The band 14 is preferably soft so that it cannot mar or tear the inner surface of the expandable bag as the stuffer 12 moves from the collapsed orientation to the expanded orientation, and is preferably formed of paper which is easily tearable yet possessed of sufficient strength to maintain the stuffer 12 in the collapsed orientation against the force of biasing means 24.

The band 14 is illustrated as a longitudinally extending belly band in that it extends totally about the stuffer 12, parallel to the living hinges connecting the flaps 22 and the base sheet 20. Alternatively, the band may be a transversely extending belly band, which extends totally about the stuffer 12 transverse to the living hinges, and so does not cover the entire free end of each flap 22, but only a small fraction thereof.

Further, while the band 14 has been described as extending completely about both opposed surfaces of the stuffer 12 (either longitudinally as illustrated, or transversely), it is only necessary for the band 14 to extend for a distance sufficient to releasably maintain the stuffer 12 in the collapsed orientation. For example, the band 14 does not need to extend over the full longitudinal dimension of both surfaces of the base sheet 20, but may simply have free ends which are glued or otherwise secured to the appropriate edges of the base sheet 20. As another example, the band 14 does not need to extend over the full transverse dimension of both surfaces of the base sheet 20, and indeed need not contact the base sheet 20 at all, but may simply extend across the adjacent portions of the two flaps 22 and be glued or otherwise secured thereto.

The tearing means 16 is typically a string or like means for tearing the tearable band 14, thereby to enable the stuffer to move from the collapsed orientation to the expanded orientation under the influence of the biasing means 24. The string 16, like the band 14, is preferably soft so that it cannot mar or tear the inner surface of the expandable bag even as the string 16 is being pulled in order to release the stuffer 12 for movement from the collapsed orientation to the expanded orientation.

As illustrated, the string 16 forms a loop 30 about a segment of the band 14 so that removal of the string 16, and in particular the loop 30 thereof, from the band 14 necessarily tears the band 14, thereby releasing the stuffer 12 for movement from the collapsed orientation to the expanded orientation as the flaps 22 are then free to move under the influence of biasing means 24. Alternatively, the string 16 may be secured to the band 14 by being directly secured thereto in one form or another. For example, the tearable string 16 may be glued or otherwise secured directly to the band 14, or may even be incorporated as an integral portion of the structure of the band 14. Alternatively, the string 16 may be secured to the stuffer 12 directly at one or more points (and not directly connected to the band 14) provided that, when the free end 32 of string 16 is pulled a portion of string 16 adjacent the stuffer 12 causes the band 14 to be torn. The loop 30 is illustrated as extending transverse to the longitudinal axis of the band 14, thereby to minimize the length of the band 14 to be torn and hence the force of the pull required. However in particular instances—for example, where there is a transversely extending band 14 or where band 14 secures together the free ends of the flaps 22 and does not contact in any way base sheet 20—the loop 30 may be disposed longitudinally so that, when the string 16 is pulled away from the stuffer 12, the band 14 is bisected with one portion remaining on each of the two flaps 22 and the two flaps 22 then being free to move into the expanded orientation.

The string 16 is preferably flexible so that it can have one end (i.e., the end with loop 30) disposed within the bag and the other or free end 32 disposed outside of the bag where it can be gripped and pulled in order to cause tearing of the band 14.

Referring now to FIG. 2, therein illustrated is an expander 10 in combination with an expandable bag 40, the stuffer 12 being in the collapsed orientation. The expandable bag 40 is in a collapsed orientation, suitable for economical shipment and storage, and is provided with a closure 42, such as a zipper closure, which is illustrated as closed. The string 16 is partially disposed within the bag 40 (see loop 30) and partially without or outside of the bag 40 (see free end 32). Zipper closures typically have a slight aperture (not shown) at one end or the other where they connect to the bag 40, and the flexible string 16 can easily be threaded therethrough, the aperture being of a size to permit sliding movement of the string 16 relative thereto. Alternatively, other portions the bag 40 may provide some means for passage therethrough of the string 16.

Referring now to FIG. 3, therein illustrated is the same combination as illustrated in FIG. 2 after the string 16 has been pulled from outside the bag sufficiently to tear the band 14 and allow the expander 10 to expand the bag 40. As illustrated, the string loop 30 has come entirely free of the band 14 and been displaced entirely from the bag 40 with the remainder of the string 16. It will be appreciated, however, that in particular instances the string 16 may remain at least partially secured to the stuffer 12 or band 14 so that it is not entirely removed from the bag 40. Torn fragments **14*a* of the band 14 are illustrated in FIG. 3**.

As the string 16 and band 14 are preferably formed of soft (that is, non-scratching) materials, marring or tearing of the inner surface of the expandable bag 40 cannot occur either during insertion of the expander 10 into the bag 40, during storage of the expander 10 within the collapsed bag 40, or during the process of the expander 10 expanding the bag 40. In other words, neither the string 16 as it is pulled, nor the band 14 as it is torn, will mar or tear the inner surface of the bag 40.

It will be appreciated that the present invention is not limited in its application to bags, but may be used as well for the expansion of other hollow collapsible articles wherein it may be desired to store the articles flat, but to expand them for display.

To use the expander 10, the stuffer 12 in a collapsed orientation, with the band 14 thereabout and the loop 30 of string 16 about the band 14, is disposed in a bag 40 by the manufacturer. When the retailer decides to put the bag on display, he has only to pull the free end 32 of string 16 with sufficient force that the loop 30 of string 16 tears the band 14, thereby enabling the flaps 22 of the stuffer 12 to move under the influence of biasing means 24. Accordingly, the stuffer 12, and hence the bag 40, assumes an expanded orientation.

To summarize, the present invention provides an expander which does not present a threat of marring or tearing to either the interior or exterior surfaces of the bag. Further, the expander is operable in a closed bag by means of a string disposed partially outside of the bag and, in a preferred embodiment of the present invention, permits the string to be totally removed from the bag as part of the process of moving the stuffer from the collapsed orientation to the expanded orientation. The expander does not leave in the bag small members which pose a danger to children opening the bag. The present invention further provides in combination such an expander and an expandable bag.

Now that the preferred embodiments of the present invention have been shown and described and detail, various modifications and improvements thereon will be readily apparent to those skilled in the art. Accordingly, the spirit and scope of the present invention is be construed broadly and not limited by the appended claims, but only by the foregoing specification.

I claim:

1. An expander for use in an expandable bag having a closure, said expander comprising:

(A) a stuffer including a plurality of panels and biasing means, said plurality of panels being movable from a collapsed orientation wherein said stuffer is substantially flat to an expanded orientation wherein said stuffer is not substantially flat and, when disposed within an expanded expandable bag, causes the expandable bag to maintain an expanded configuration, said biasing means biasing said panels for movement from said collapsed orientation to said expanded orientation so that, when said stuffer is disposed within a non-expanded expandable bag, said stuffer causes the expandable bag to assume an expanded configuration;

(B) tearable means including a strip of tearable material disposed about said stuffer for releasably maintaining said panels in said collapsed orientation; and (C) tearing means including a portion extending across said tearable means for tearing said tearable means to enable said panels to move from said collapsed orientation to said expanded orientation, said tearing means being operable from outside the expandable bag.

2. The expander of claim 1 wherein said tearable means is disposed about said stuffer in said compact orientation and intended to be disposed therewith within the bag.

3. The expander of claim 1 wherein said tearing means is secured to at least one of said stuffer and said tearable means and intended to be disposed therewith partially within the bag and partially without the bag.

4. The expander of claim 3 wherein said tearing means is secured to said stuffer.

5. The expander of claim 3 wherein said tearing means is secured to said tearable means.

6. The expander of claim 1 wherein said tearable means is non-woven fibrous textile cloth.

7. The expander of claim 1 wherein said tearable means is paper.

8. The expander of claim 1 wherein said tearing means is string.

9. The expander of claim 1 wherein said tearable means and said tearing means are flexible.

10. The expander of claim 1 wherein said tearable means and said tearing means are soft.

11. The expander of claim 1 wherein said tearable means is disposed exclusively externally of said stuffer.

12. In combination, the expander of claim 1 and an expandable bag having a closure, said closure being closed, said stuffer being disposed in said bag in said collapsed orientation, said tearable means being disposed in said bag, and said tearing means being disposed partially within said bag and partially without said bag.

13. An expander for use in an expandable bag having a closure, said expander comprising:

(A) a stuffer including a plurality of panels and biasing means, said plurality of panels being movable from a collapsed orientation wherein said stuffer is substantially flat to an expanded orientation wherein said stuffer is not substantially flat and, when disposed within an expanded expandable bag, causes the expandable bag to maintain an expanded configuration, said biasing means biasing said panels for movement from said collapsed orientation to said expanded orientation so that, when said stuffer is disposed within a non-expanded expandable bag, said stuffer causes the expandable bag to assume its expanded configuration;

(B) soft, flexible tearable means including a strip of tearable material for releasably maintaining said stuffer in said collapsed orientation, said tearable means being disposed about said panels in said compact orientation and intended to be disposed therewith within the expandable bag; and (C) soft, flexible tearing means including a portion extending across said tearable means for tearing said tearable means to enable said panels to move from said collapsed orientation to said expanded orientation, said tearing means being operable from outside the expandable bag, said tearing means being secured to at least one of said stuffer and said tearable means and intended to be disposed therewith partially within the bag and partially without the expandable bag.

14. In combination, the expander of claim 12 and an expandable bag having a closure, said closure being closed, said stuffer being disposed in said bag in said collapsed orientation, said tearable means being disposed in said bag and disposed exclusively externally of said stuffer for maintaining said stuffer in said collapsed orientation, and said tearing means being disposed partially within said bag and partially without said bag.

* * * * *